US011441851B2

(12) United States Patent
Tissot et al.

(10) Patent No.: US 11,441,851 B2
(45) Date of Patent: Sep. 13, 2022

(54) REFRIGERANT FLUID DISTRIBUTION DEVICE INTENDED TO BE ACCOMMODATED IN A HEADER OF A HEAT EXCHANGER

(71) Applicant: Valeo Systemes Thermiques, Le Mesnil-Saint-Denis (FR)

(72) Inventors: Julien Tissot, Le Mesnil Saint Denis (FR); Kamel Azzouz, Le Mesnil Saint Denis (FR); Amrid Mammeri, Le Mesnil Saint Denis (FR); Jérôme Mougnier, Le Mesnil Saint Denis (FR); Jérémy Blandin, Le Mesnil Saint Denis (FR)

(73) Assignee: Valeo Systemes Thermiques, Le Mesnil Saint-Denis (FR)

( * ) Notice: Subject to any disclaimer, the term of this patent is extended or adjusted under 35 U.S.C. 154(b) by 154 days.

(21) Appl. No.: 16/955,344

(22) PCT Filed: Dec. 18, 2018

(86) PCT No.: PCT/EP2018/085522
§ 371 (c)(1),
(2) Date: Jun. 18, 2020

(87) PCT Pub. No.: WO2019/121699
PCT Pub. Date: Jun. 27, 2019

(65) Prior Publication Data

US 2021/0088295 A1 Mar. 25, 2021

(30) Foreign Application Priority Data

Dec. 19, 2017 (FR) ..... 1762509

(51) Int. Cl.
*F28F 9/02* (2006.01)
*F25B 39/00* (2006.01)
*F25B 39/02* (2006.01)

(52) U.S. Cl.
CPC ..... *F28F 9/0273* (2013.01); *F25B 39/00* (2013.01); *F25B 39/028* (2013.01)

(58) Field of Classification Search
CPC ..... F28F 9/0273; F28F 9/027; F28F 9/0275; F25B 39/00; F25B 39/028
(Continued)

(56) References Cited

U.S. PATENT DOCUMENTS

2013/0020061 A1 1/2013 Bergh
2017/0219298 A1* 8/2017 Tsutsui ..... F28F 9/02
2018/0156512 A1* 6/2018 Mislak ..... F25B 39/028

FOREIGN PATENT DOCUMENTS

EP 2392886 A2 12/2011
EP 2784428 A1 10/2014
(Continued)

OTHER PUBLICATIONS

International Search Report and Written Opinion in corresponding International Application No. PCT/EP2018/085522, dated Mar. 29, 2019 (7 pages).

*Primary Examiner* — Henry T Crenshaw
*Assistant Examiner* — Kamran Tavakoldavani
(74) *Attorney, Agent, or Firm* — Osha Bergman Watanabe & Burton LLP

(57) ABSTRACT

The invention concerns a device for distribution of a refrigerant fluid in a header of a heat exchanger comprising at least two conduits (12, 13), an external conduit (12) and an internal conduit (13), with the internal conduit accommodated in the external conduit in such a manner as to form a volume (14) for communication between the internal con-
(Continued)

Figure 1:
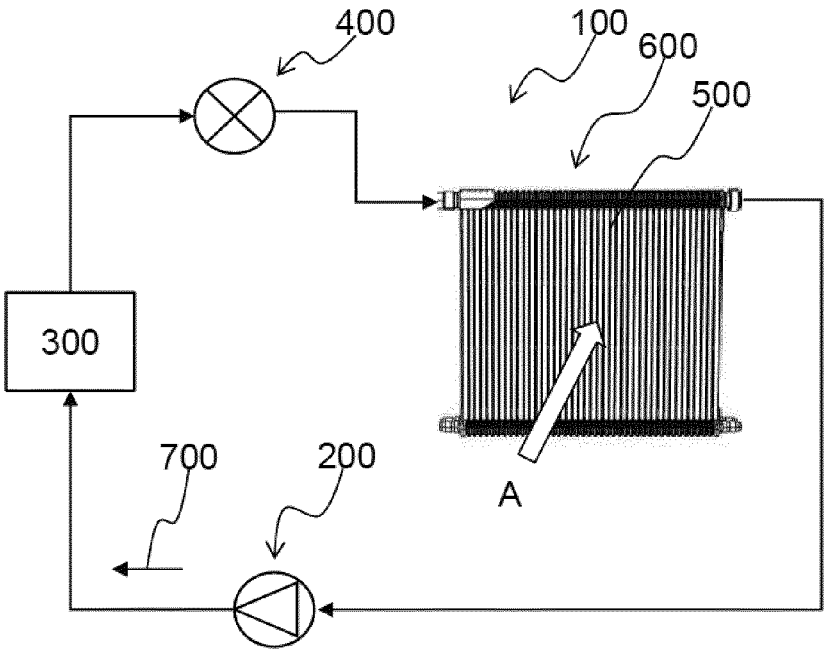

duit and the external conduit, the external conduit comprising spraying orifices (120) each having an axis (120A) intersecting a principal lengthwise axis (12A) of the external conduit, the internal conduit comprising at least one communication orifice having an axis intersecting a principal lengthwise axis of the internal conduit. According to the invention, the internal conduit (13) comprises a portion (16) of reduced thickness formed by removal of material from an external face of the internal conduit (13), the external face facing toward the external conduit (12).

20 Claims, 5 Drawing Sheets

(58) Field of Classification Search
USPC ..... 165/142
See application file for complete search history.

(56) References Cited

FOREIGN PATENT DOCUMENTS

WO 2009002256 A1 12/2008
WO WO-2009002256 A1 * 12/2008 ..... F25B 41/062

* cited by examiner

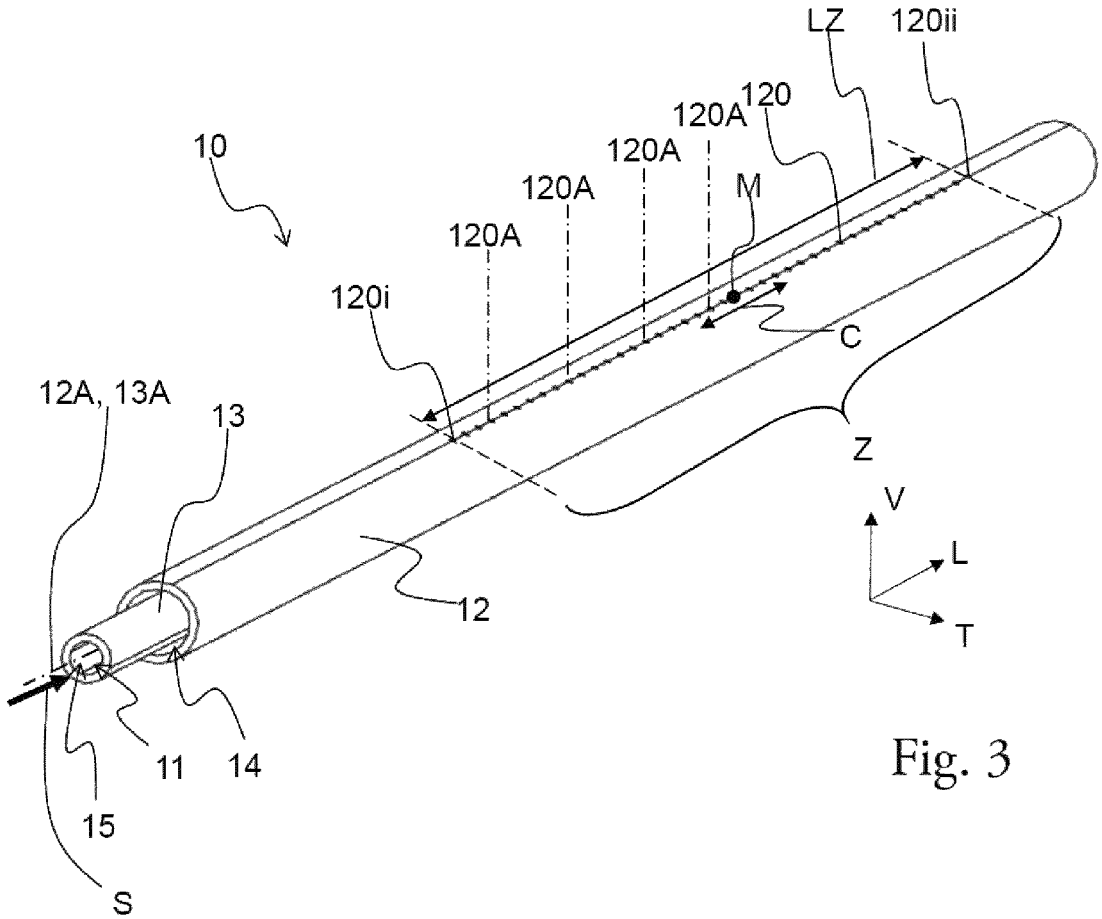
Fig. 3
Fig. 4
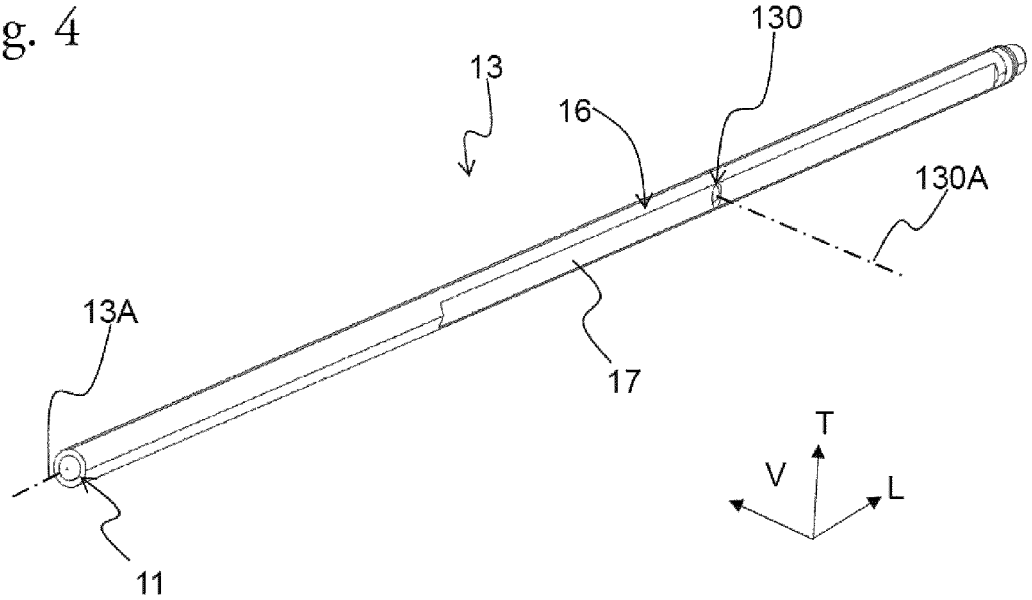

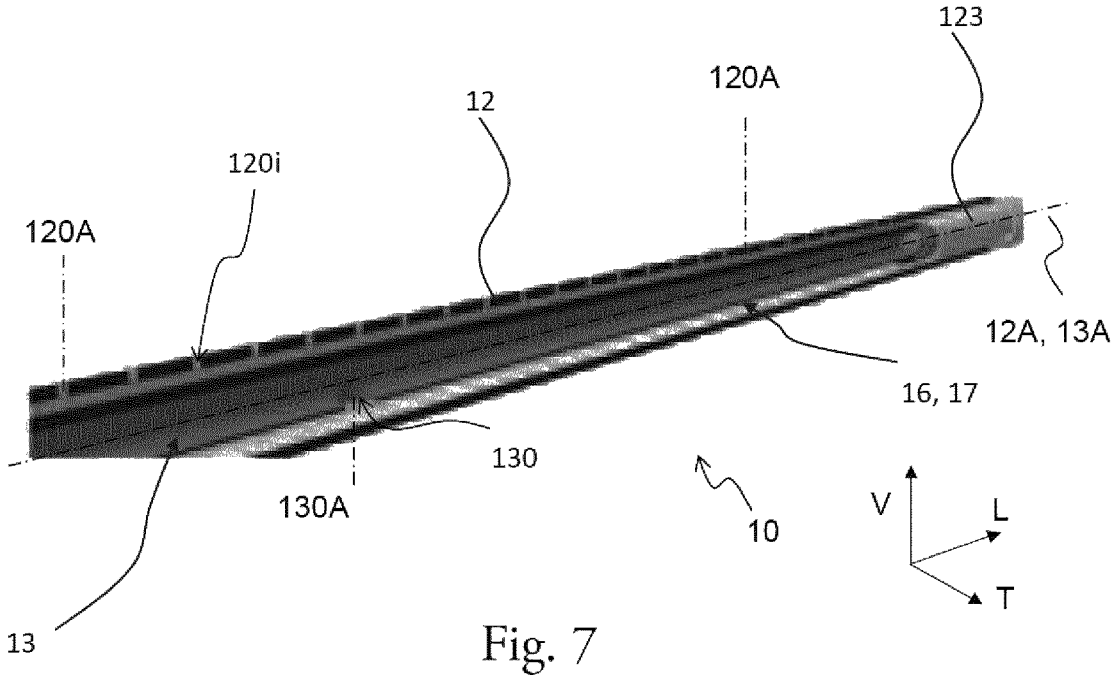
Fig. 7
Fig. 8
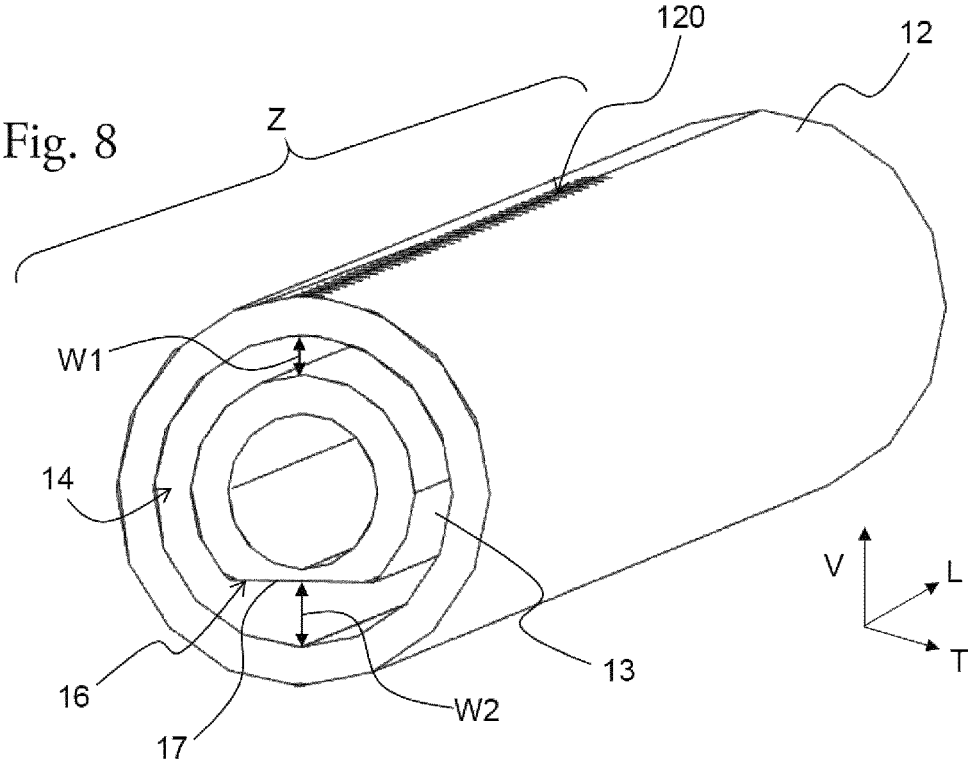

REFRIGERANT FLUID DISTRIBUTION DEVICE INTENDED TO BE ACCOMMODATED IN A HEADER OF A HEAT EXCHANGER

FIELD OF THE INVENTION

The field of the present invention is that of the heat exchangers equipping air conditioning installations for vehicles, notably motor vehicles. The invention more specifically concerns the distribution of the refrigerant fluid inside a header that a heat exchanger of this kind includes and consists in a refrigerant fluid distribution device, the associated header and the associated heat exchanger.

DESCRIPTION OF RELATED ART INCLUDING INFORMATION DISCLOSED UNDER 37 CFR 1.97 AND 1.98

A vehicle is routinely equipped with an air conditioning installation for heat treatment of the passenger compartment of the vehicle. An installation of this kind then cooperates with a closed loop refrigerant fluid circuit. That refrigerant fluid circuit comprises in succession, in the direction of circulation of the refrigerant fluid, a compressor, a condenser, a thermostatic expansion valve and at least one heat exchanger.

The heat exchanger can notably be a tube exchanger in which a bundle of tubes extends between a header and a return box for the refrigerant fluid. The refrigerant fluid is admitted via an inlet opening to the interior of the header, circulates in successive paths in the tubes of the bundle between the header and a return box, and is then evacuated from the heat exchanger via an outlet opening. The outlet opening can be formed in the header or the return box.

The heat exchanger is for example a condenser, an evaporator or a liquid cooler. This heat exchanger is intended to perform an exchange of heat between the refrigerant fluid and a flow of fluid, such as respectively outside air, a flow of air circulating in the air conditioning installation or a heat-exchange fluid. To this end, the refrigerant fluid circulates inside the tubes of the bundle and the flow of fluid circulates between the tubes of the bundle to cool it, the exchange of heat being effected by conduction.

However, a disadvantage linked to a heat exchanger of this kind resides in heterogeneous feeding of the tubes of the bundle. In particular, the refrigerant fluid is admitted to the interior of the heat exchanger in a diphase liquid/gas state, and the difference between the physical properties of a liquid and a gas means that the liquid phase and the gas phase of the refrigerant fluid tend to separate. As a result, the tubes of the bundle closest to the inlet opening can then be fed mainly with liquid whereas the tubes of the bundle at the greatest distance from the inlet opening may be fed mainly with gas, or vice versa depending on the arrangement of the heat exchanger.

The heterogeneous feeding of the tubes of the bundle then generates a disparity in the exchange of heat between the refrigerating fluid and the flow of fluid through the heat exchanger and a disparity in the temperature of the flow of fluid that has passed through the heat exchanger in use. This heterogeneity complicates the thermal management of the installation that receives the heat exchanger and in the case of an evaporator implies temperature differences between two zones of the passenger compartment, although the same air flow temperature is requested.

In order to remedy a disadvantage of this kind, the document EP 2 392 886 proposes to accommodate a conduit provided with a plurality of orifices inside a header. The liquid phase refrigerant fluid is therefore sprayed through the orifices in the form of droplets over the whole of the length of the conduit. Although it enables improvement of the distribution of the fluid inside the header, an arrangement of this kind can generate high head losses, notably because of the small size of each of the orifices allowing the passage of fluid, which can lead to revising the whole of the refrigerant fluid circuit in order to feed the heat exchanger correctly.

BRIEF SUMMARY OF THE INVENTION

In this context, the present invention consists in a device for distribution of a refrigerant fluid in a header of a heat exchanger comprising at least two conduits, including an external conduit and an internal conduit, with the internal conduit accommodated in the external conduit in such a manner as to form a volume for communication between the internal conduit and the external conduit, the external conduit comprising spraying orifices each having an axis intersecting a principal lengthwise axis of the external conduit, the internal conduit comprising at least one communication orifice having an axis intersecting a principal lengthwise axis of the internal conduit. According to the invention, the internal conduit comprises a portion of reduced thickness formed by removal of material from an external face of the internal conduit, the external face facing toward the external conduit.

The presence of a portion of reduced thickness of this kind enables an increase in the size of the communication volume between the internal conduit and the external conduit, which allows the refrigerant fluid passing through the communication orifice or orifices to be distributed better along the communication volume, whether in terms of fluid circulation or of mixing a liquid phase and a gas phase of the refrigerant fluid.

Clearly the so-called communication orifice or orifices is or are so called because they allow the refrigerant fluid to circulate from the interior of the internal conduit to the communication volume between the two conduits, prior to being evacuated via the spraying orifices.

According to one or more features that can be considered separately or in combination:

- The spraying orifices are all situated in a spraying zone in which they are arranged in a longitudinal series comprising a first spraying orifice and a last spraying orifice, the first spraying orifice and the last spraying orifice being disposed at opposite ends of the longitudinal series. By longitudinal series is meant a series extending along the lengthwise axis of the conduit, here of the external conduit.
- The longitudinal series of spraying orifices is distributed in a rectilinear manner and parallel to the principal lengthwise axis of the external conduit.
- The spraying orifices are regularly aligned in the spraying zone of the external conduit.
- The removal of material forms a flat on the external face of the internal conduit. By flat is meant a plane surface formed on a circular section. It is then clear that the internal conduit is of circular section and that at least a part of the external face of the internal conduit features a plane surface.

The flat extends over at least 50% of the length of the internal conduit, the length being defined as a dimension measured along the principal lengthwise axis of the internal conduit.

The flat extends at least over a portion of the internal conduit, in which the at least one communication orifice is formed.

The portion of reduced thickness extends over a length equal to a length of the spraying zone. Accordingly, the portion of reduced thickness, and where applicable the flat, extend or extends over a distance equal to a distance separating the first spraying orifice and the last spraying orifice of the longitudinal series. In other words, the portion of reduced thickness extends over a longitudinal part of the distribution device that at least partially intersects the spraying zone.

The portion of reduced thickness extends in a rectilinear manner along the principal lengthwise axis of the internal conduit. In other words, the portion of reduced thickness is produced along a straight line, the straight line being parallel to the principal lengthwise axis of the internal conduit.

The at least one communication orifice is formed in such a manner as to pass through a part of the portion of reduced thickness.

The at least one communication orifice has a contour of circular shape.

The at least one communication orifice has a contour of polygonal shape. For example, the communication orifice has a contour of decagonal shape.

The external conduit and/or the internal conduit has or have a circular section.

The internal conduit includes at a first of its longitudinal ends an inlet opening for the admission of the refrigerant fluid into the distribution device, the internal conduit being closed at its second longitudinal end.

The internal conduit and the external conduit are coaxial.

According to a series of features of the invention, the internal conduit may have a single communication orifice. The presence of a single orifice on the internal conduit enables introduction of the fluid into a single part of the external conduit, which enables better management of the feeding of the external conduit with refrigerant fluid. Moreover, the presence of a single orifice on the internal conduit enables reduction of the head losses relative to the situation where it would comprise a plurality of holes.

The axis of the single communication orifice may be substantially aligned with the middle of the spraying zone. It is therefore clear that the communication orifice discharges at substantially equal distances from the two spraying orifices at the greatest distances from the external conduit, that is to say at equal distances from the first spraying orifice and the last spraying orifice of the longitudinal series. The term substantially means that an uncertainty of plus or minus 5% is permitted to specify that the axis of the communication orifice is aligned with the middle of the spraying zone. It will be clear that the presence of a single orifice on the internal conduit enables introduction of the fluid into a particular zone of the external conduit, which enables better management of the feeding of the external conduit with refrigerant fluid. Moreover, the presence of a single orifice on the internal conduit facilitates modification of the dimension thereof and, as a function of that dimension, reduction of the head losses on passing through the internal conduit.

The single communication orifice may have a greatest dimension, measured in a section plane perpendicular to the axis of the single communication orifice, less than or equal to a greatest dimension of the internal conduit, measured in a section plane perpendicular to the principal lengthwise axis of the internal conduit. Such a dimension ensures good distribution of the fluid between the two conduits and limits the associated head loss.

According to one particular embodiment, the single communication orifice has a section of at least 4 millimetres diameter.

According to a series of features, considered separately or in combination with each other and with the foregoing features:

The removal of material forming the portion of reduced thickness is effected over a part of the internal conduit facing a solid portion of the external conduit. By solid portion of the external conduit is meant a portion with no spraying orifices. Accordingly, the portion of reduced thickness is not disposed facing the spraying zone defined above.

The at least one communication orifice discharges into a solid portion of the external conduit. By solid portion of the external conduit is meant a portion with no spraying orifices.

The at least one communication orifice and the at least one spraying orifice discharge in parallel opposite directions.

The communication orifice discharges in an opposite direction to the spraying orifices. In other words, the communication orifice discharges facing a part of the external conduit diametrically opposite, or symmetrically opposite, the spraying zone of the external conduit.

The flat lies in a plane perpendicular to the axes of the spraying orifices. In other words, the flat is situated facing a part of the external conduit diametrically opposite, or symmetrically opposite, the spraying zone of the external conduit.

The portion of reduced thickness extends in a rectilinear manner along the principal lengthwise axis of the internal conduit. In other words, the portion of reduced thickness is positioned along a straight line, the straight line being colinear with the principal lengthwise axis of the external conduit.

A greatest distance separating a centre of the flat and an internal face of the external conduit is between 1 and 5 millimetres inclusive.

A shortest distance separating an external face of the internal conduit, in a portion distinct from the flat, and the internal face of the external conduit is between 0.25 and 2 millimetres inclusive.

The portion of reduced thickness of the internal conduit is produced by machining.

The invention also concerns a refrigerant fluid header for a heat exchanger comprising a distribution chamber. The distribution chamber accommodates a distribution device as defined above, and the internal conduit of the distribution device comprises an inlet opening for admission of the refrigerant fluid, the spraying orifices being arranged in such a manner as to allow circulation of the refrigerant fluid between the distribution device and the distribution chamber.

The distribution device may extend along a lengthwise axis of the header, with the internal conduit including at a first of its two longitudinal ends the inlet opening for the admission of the refrigerant fluid into the internal conduit, the internal conduit being closed at a second longitudinal end.

The invention further concerns a heat exchanger including at least one header as defined above, and tubes forming a bundle of tubes extending from the header, characterized in that the internal conduit of the distribution device is oriented in such a manner that the removal of material to form the portion of reduced thickness is effected in a zone of the internal conduit facing the bundle of tubes. For example, if the removal forms a flat, it is clear that the plane surface of the flat is perpendicular to the axes of the tubes of the bundle and that it is formed in the external face of the internal conduit closest to the bundle of tubes.

The spraying zone of the external conduit may have a length equal to a length of the bundle of tubes.

The portion of reduced thickness may be formed over a length of the internal conduit equal to a length of the bundle of tubes.

BRIEF DESCRIPTION OF THE SEVERAL VIEWS OF THE DRAWING(S)

Figure 2:
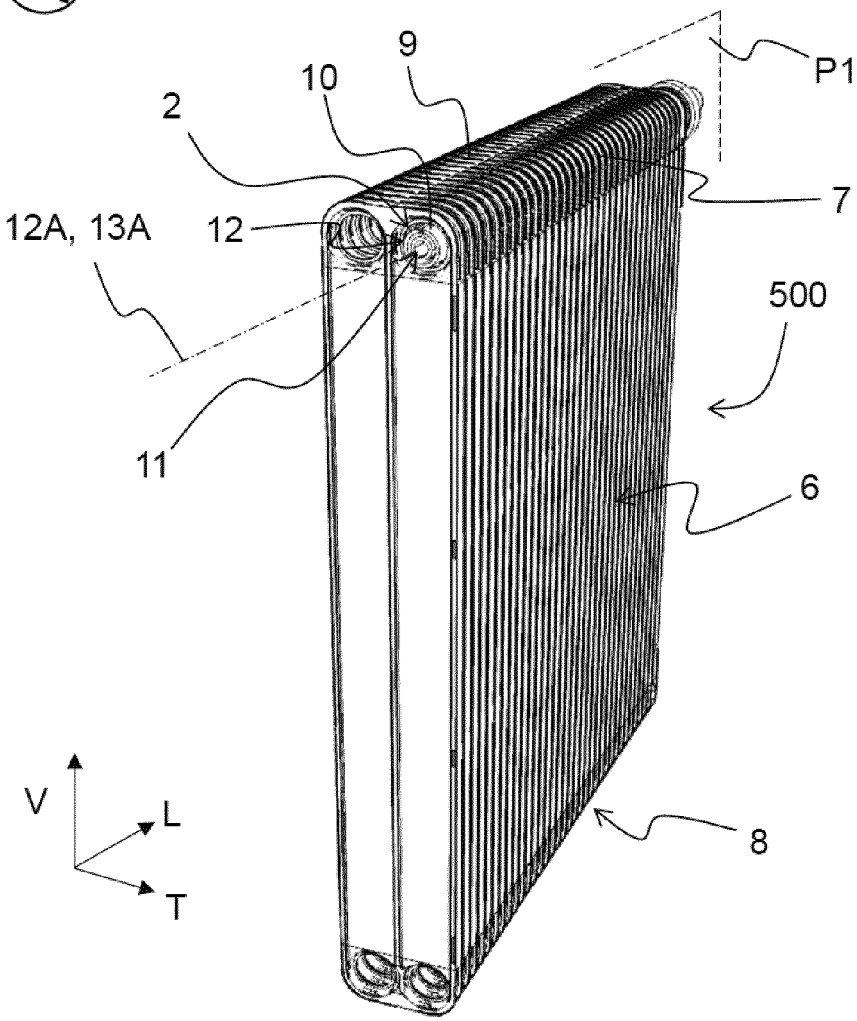
Figure 5:
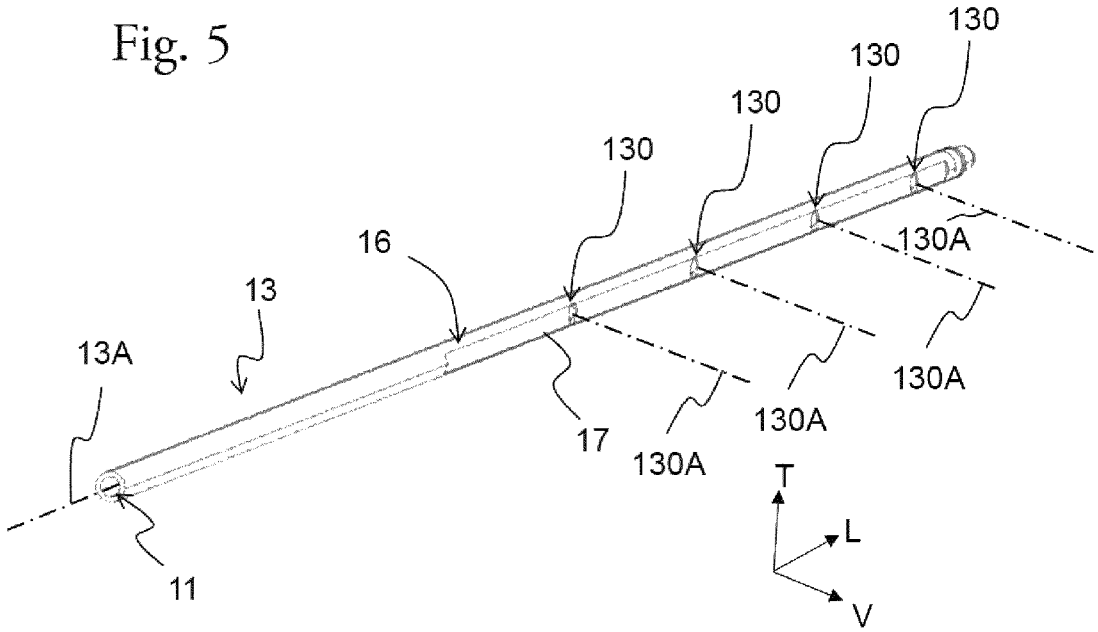
Figure 6:
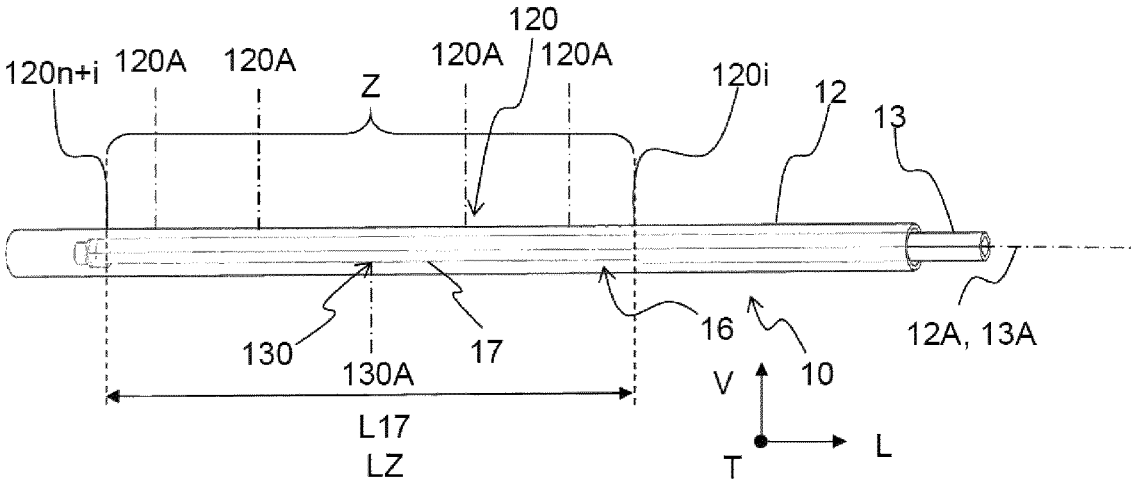
Figure 9:
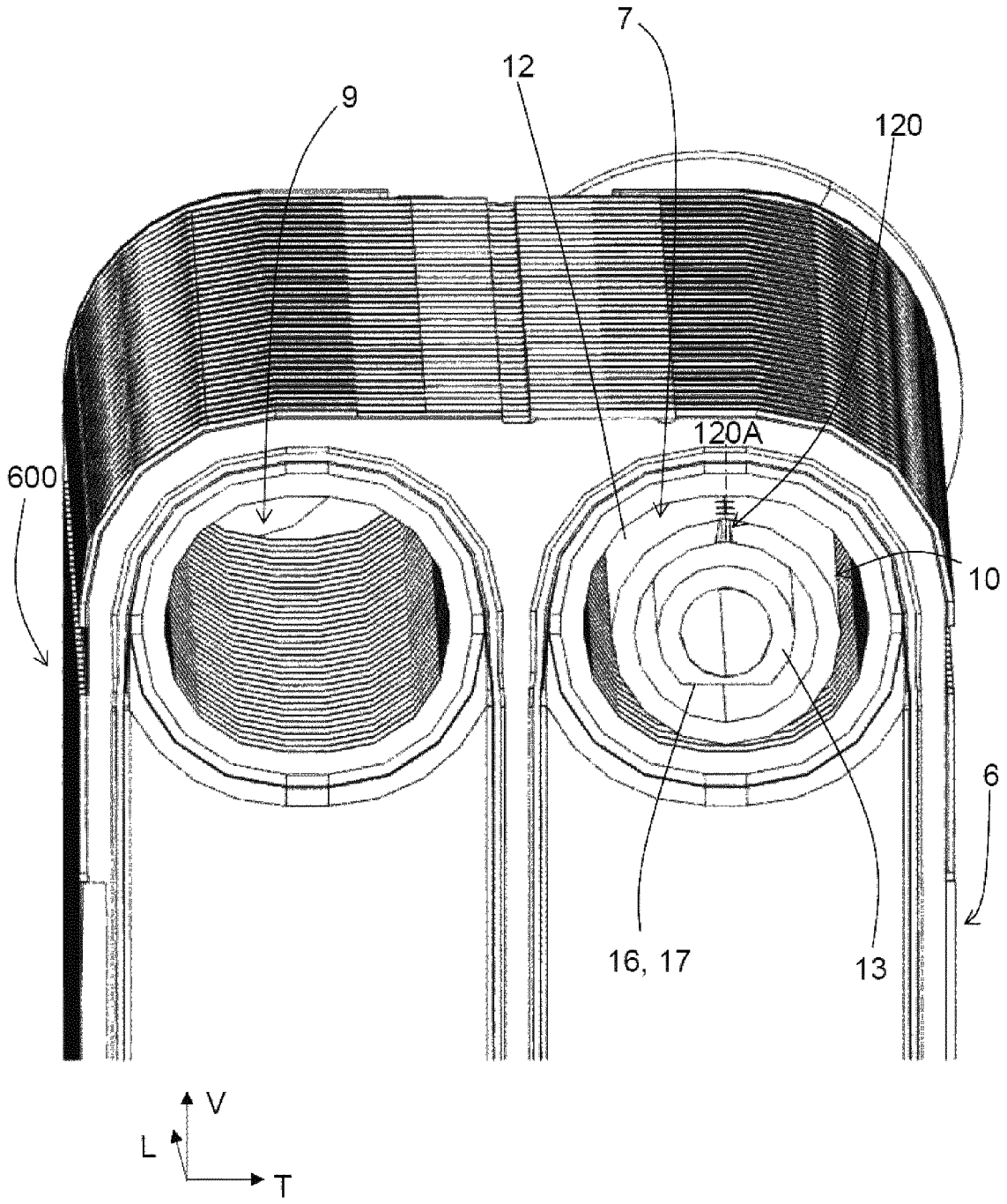

Other features, details and advantages of the invention will emerge more clearly on reading the detailed description given hereinafter by way of illustrative example with reference to the drawings of the appended sheets, in which:

FIG. 1 is a diagram representing a circulation circuit of a refrigerant fluid participating in an air conditioning installation of a vehicle, FIG. 2 is a sectional representation of a heat exchanger, in accordance with the present invention, that the circuit from FIG. 1 includes, FIG. 3 shows a refrigerant fluid distribution device, in accordance with the present invention, adapted to be arranged in a header of the heat exchanger from FIG. 2, FIG. 4 shows an internal conduit of the refrigerant fluid distribution device shown in FIG. 3, the internal conduit being viewed at an angle rendering visible a portion of reduced thickness, FIG. 5 is a side view of the refrigerant fluid distribution device from FIG. 3, in which the external conduit of this distribution device has been rendered transparent to render visible the internal conduit in its entirety, FIG. 6 is a side view, similar to that of FIG. 5, of a variant embodiment of the internal conduit of the refrigerant fluid distribution device according to the present invention, FIG. 7 is a perspective sectional view of the distribution device along its lengthwise axis, notably rendering visible the orientation of a single communication orifice and a flat formed on the internal conduit relative to the spraying orifices on the external conduit, FIG. 8 is a sectional view of the refrigerant fluid distribution device according to the present invention, FIG. 9 is a detail view of the heat exchanger from FIG. 2, in which has been rendered more particularly visible the header equipped with the refrigerant fluid distribution device according to the present invention.

It is first of all to be noted that although the figures show the invention in detail for its implementation, they can of course serve to define the invention better if necessary. Similarly, it is pointed out that, in all the figures, the same elements are designated by the same references.

DETAILED DESCRIPTION OF THE INVENTION

FIG. 1 shows a circuit 100 for a refrigerant fluid 700 intended to cooperate with an air conditioning installation for a passenger compartment of a vehicle, notably a motor vehicle. This circuit 100 is arranged as a closed loop inside which the refrigerant fluid 700 circulates in a circulation direction shown by the arrow. In the embodiment shown, the circuit 100 comprises, successively in the direction of circulation of the refrigerant fluid 700, a compressor 200, a condenser 300, an expansion member 400 and at least one heat exchanger 500. It is to be noted that the condenser 300 is a heat exchanger enabling cooling of the refrigerant fluid 700 with the aid of a flow of external air, before the expansion of the refrigerant fluid 700. The heat exchanger 500 advantageously forms part of the air conditioning installation and in this case takes the form of an evaporator 600.

In order to connect the various elements constituting the circuit 100, the latter comprises channels and valves to control the flow. It is to be noted that a minimalist circuit 100 of this kind is given as an example and is not restrictive on the scope of the invention given the various architectures that the circuit 100 can have.

The heat exchanger 500, in the form of an evaporator 600, is dedicated to cooling a flow of air A circulating in the air conditioning installation. A flow of air A of this kind is notably used to heat treat the air in the passenger compartment of the vehicle or for example to cool a unit of the vehicle in operation. According to another embodiment, the heat exchanger 500 is a cooler and is dedicated to cooling a liquid enabling cooling of a unit of the vehicle in operation, such as one or more batteries supplying electrical energy to an electrical drive train of the vehicle.

FIG. 2 shows that the heat exchanger 500 comprises a bundle of tubes 6, a header 7 and an outlet box 9. According to this embodiment, the heat exchanger 500 also comprises a return box 8 enabling the refrigerant fluid to circulate by forming a plurality of passages in the bundle of tubes 6 before rejoining the outlet box 9. The tubes of the bundle of tubes 6 in this case extend between the header 7 and the return box 8. To be more precise the tubes of the bundle 6 are arranged in layers with a first layer forming a first principal face of the heat exchanger 500 and a second layer forming a second principal face of the heat exchanger 500. By principal face is meant a face of the heat exchanger 500 having one of the largest areas.

According to a variant embodiment not shown here, the heat exchanger 500 comprises a header 7 at one of the ends of the bundle of tubes and an outlet box 9 disposed at the other end of the bundle of tubes 6.

In the following description, an orientation is referred to as a function of the longitudinal axis L, vertical axis V and transverse axis T, as defined by the trihedron L, V, T represented in FIGS. 2 to 9. The vertical axis V corresponds to the principal lengthwise direction of a given tube of the bundle of tubes 6 of the heat exchanger 500 and corresponds to the principal direction followed by the refrigerant fluid circulating inside the tubes of the heat exchanger 500. The transverse axis T, perpendicular to the vertical axis V, corresponds to the principal direction taken by the flow of fluid, such as the flow of air A, to be cooled by the heat exchanger 500 on passing through the bundle of tubes 6. Finally, the longitudinal axis L is perpendicular both to the vertical axis V and to the transverse axis T and follows a lengthwise direction of one of the boxes of the heat exchanger 500, whether that be the header, the return box or the outlet box. It is to be noted that the choice of names for these axes is not limiting on the orientation that the heat exchanger can have in its application to a vehicle, notably a motor vehicle.

Accordingly, in this frame of reference, the header 7 and the return box 8 are disposed at two opposite vertical ends of the bundle of tubes 6, with the header 7 disposed at a first vertical end and the return box at a second vertical end of the bundle of tubes 6. The outlet box 9 is disposed beside the header 7, along the transverse axis T, at the first vertical end of the bundle of tubes 6. The header 7 and the outlet box 9 are advantageously of unitary construction, that is to say they are made in one piece.

The header 7 delimits a distribution chamber 2 that is fed with refrigerant fluid 700 with the aid of a distribution device 10 accommodated in the header 7 and into which a plurality of tubes of the bundle of tubes 6 discharge.

The distribution device 10, which will be described in more detail later, includes an inlet opening 11 for admission of the refrigerant fluid 700 into the heat exchanger 500 and notably into the distribution device 10 that is configured to distribute the refrigerant fluid 700 along the header 7.

Once the refrigerant fluid 700 is inside the heat exchanger 500, it circulates along the tubes of the bundle of tubes 6 in such a manner as to cool them in one or more passes with the aid of the return box 8. The refrigerant fluid 700 is then evacuated from the heat exchanger 500 via an outlet opening 12 provided on the outlet box 9.

According to the arrangement of the heat exchanger 500 shown, the circulation of the refrigerant fluid 700 is in the shape of a "U". According to a variant embodiment, the heat exchanger 500 is of the multiple pass type, that is to say the return box 8 is compartmented so that the refrigerant fluid 700 effects a plurality of passes through one layer of tubes before reaching the second layer and the outlet box. If the heat exchanger 500 does not include a return box 8 and comprises instead the outlet box 9, the circulation of the refrigerant fluid in the shape of an "I".

Moreover, in the context of its application to an air conditioning installation, the heat exchanger 500 is intended to cool a flow of air A passing through the bundle of tubes 6 in a direction transverse to their lengthwise direction. In other words, the flow of air A passes through the bundle 6 transversely to a longitudinal plane P1 of the heat exchanger 500. To improve the exchange of heat, the tubes of the bundle 6 include, for example, fins encouraging the exchange of heat between the flow of air A and the tubes of the bundle 6.

The refrigerant fluid 700 circulates from the header 7 to a first layer of tubes of the bundle 6 dedicated to feeding the return box 8 with refrigerant fluid 700. The refrigerant fluid 700 then circulates from the return box 8 to the outlet box 9 through a second layer of tubes of the bundle 6. The first layer and the second layer are superposed one on the other on each side of the longitudinal plane P1.

The distribution chamber 2 of the header 7 accommodates the distribution device 10 extending along a lengthwise axis parallel to the direction in which the header 7 extends. The distribution device 10 comprises at least two conduits 12, 13, an internal conduit 13 configured to receive the refrigerant fluid via one of its longitudinal ends forming the inlet opening 11 and to transfer that fluid to an external conduit 12, which for its part is configured to enable the passage of refrigerant fluid toward each of the tubes of the bundle of tubes 6. To be more precise, the internal conduit 13 is accommodated in the external conduit 12. Each of the conduits 12, 13 of the distribution device 10 extends along a respective lengthwise axis 12A and 13A.

Each conduit 12, 13 of the distribution device 10 more particularly extends parallel to the lengthwise direction of the header 7, parallel to the longitudinal axis L. In other words, the lengthwise axis of each of the conduits 12, 13 is parallel to the lengthwise direction of the header 7. According to a variant embodiment, not shown here, at least one of the conduits 12, 13 of the distribution device 10 extends obliquely to the direction in which the header 7 extends.

According to the example shown, the conduits 12, 13 are coaxial, with the result that the lengthwise axes 12A, 13A coincide. In order to retain the conduits in this position, the two conduits 12, 13 are separated from one another with the aid of a spacer also enabling the fixing of the distribution device 10 to the header 7. Alternatively a distribution device 10 could be provided comprising more than two conduits 12, 13, it being understood that the additional conduits would be disposed between the internal conduit 13 and the external conduit 12.

FIG. 3 showing the distribution device 10 shows that the external conduit 12 comprises so-called spraying orifices 120. The spraying orifices 120 each have an axis 120A intersecting the principal lengthwise axis 12A of the external conduit 12. Of course, if an axis of an orifice or of an opening is referred to, it is meant the axis passing through said orifice or said opening, that is to say in the principal direction of the refrigerant fluid 700 passing through that orifice or that opening. Note that each axis 120A of the spraying orifices 120 extends perpendicularly to the principal lengthwise axis 12A of the external conduit 12.

The external conduit 12 and the internal conduit 13 are hollow and each of them delimits an internal volume. There are then defined an internal volume 15 extending in the internal conduit 13 and into which the refrigerant fluid 700 is admitted from the inlet opening 11 and a communication volume 14 extending in the external conduit 12 and to be more precise between the internal conduit 13 and the external conduit 12.

According to the example shown, the external conduit 12 and the internal conduit 13 both have an end of circular section, the section of the conduit being taken in a plane transverse to the principal lengthwise axis 12A, 13A of the conduit 12, 13. Accordingly, the communication volume 14 and the internal volume 15 are each delimited by at least one of the conduits 12, 13 of which at least a part of the walls is rounded. Of course, other section shapes of the conduits 12, 13 are allowed and could for example be a square or rectangular shape.

A spraying zone Z is defined on the external conduit 12 in which all of the spraying orifices 120 are situated. The spraying orifices 120 are arranged in a longitudinal series comprising a first spraying orifice 120*i* and a last spraying orifice 120*n*+i, the first spraying orifice 120*i* and the last spraying orifice 120*n*+i being disposed at opposite longitudinal ends of the series. It is then clear that the first spraying orifice 120*i* and the last spraying orifice 120*n*+i are the spraying orifices 120 at the greatest distance from one another in the series. The first spraying orifice 120*i* and the last spraying orifice 120*n*+i can also be defined as being the first and the last of the orifices to be reached by the refrigerant fluid 700 in the direction of circulation of that fluid along the internal conduit 13, as indicated by the arrow S.

The spraying zone Z extends over a length LZ, measured along the principal lengthwise axis 12A of the external conduit 12. The middle M of this length LZ enables definition of a central part C of the spraying zone Z, the central part covering an interval of plus or minus 5% of the length LZ around the middle M.

It is to be stated that according to the embodiment shown, the spraying orifices 120 are regularly spaced in the spraying zone Z of the external conduit 12. To be more precise, the spraying orifices 120 are disposed in a rectilinear manner along the principal lengthwise axis 12A of the external conduit 12, at regular intervals. In other words, the spraying orifices 120 are positioned in a straight line, the straight line being parallel to the principal lengthwise axis 12A of the external conduit 12, with a constant pitch between two successive spraying orifices. According to a variant embodiment, the spraying orifices 120 are arranged in the form of a helix around the principal lengthwise axis 12A of the external conduit 12.

Is it is to be noted that in the example shown the external conduit 12 comprises a single row of spraying orifices 120. According to a variant embodiment, the external conduit 12 comprises a plurality of parallel rows of spraying orifices 120. It is then clear that, in this variant not shown here, the spraying zone Z comprises two first spraying orifices 120*i* and two last spraying orifices 120*n*+i.

FIG. 3 also shows that the internal conduit 13 extends longitudinally beyond the external conduit 12, here on the inlet opening side. As can be seen in FIG. 6, the external conduit 12 and the internal conduit 13 are the same length, the length being measured along their principal lengthwise axis 12A, 13A. It should be noted that the distribution device 10 comprises two support elements, one of which supports 123 is partially visible in FIG. 7, disposed at its longitudinal ends and that enable both positioning of the external conduit 12 longitudinally offset from the internal conduit 13 and their coaxial retention. A first support element is disposed at the longitudinal end opposite that of the inlet opening 11, and this support element, if necessary in two parts, is configured to close each of the conduits and to prevent the leakage of fluid at this longitudinal end. A second support element is disposed at the longitudinal end including the inlet opening, this second fixing element being perforated to allow passage to this fluid inlet. The support element can moreover be equipped with means for angular positioning of one or the other of the conduits, to provide, for example by cooperation of a slot arranged in this second support element and a rib arranged on the perimeter of one or other of the conduits, the correct position of the orifices that form the subject matter of the present invention, whether that be relative to one another or relative to a bundle of tubes.

FIG. 4 shows the internal conduit 13 separately, comprising the inlet opening 11 disposed at one longitudinal end of the internal conduit 13. In other words, the internal conduit 13 is open at one of its two longitudinal ends in such a manner as to form the inlet opening 11 for the admission of the refrigerant fluid 700 into the distribution device 10.

According to the invention, the internal conduit 13 comprises a portion 16 of reduced thickness, that is to say that at least a part of the internal conduit 13 has been subjected to a removal of material. This removal of material is effected on the external face of the internal conduit 13, that is to say on the face of the internal conduit 13 on the communication volume 14 side. This portion 16 of reduced thickness enables the communication volume 14 to be increased compared to an internal conduit 13 comprising no portion 16 of reduced thickness. The increased communication volume 14 enables improvement of the homogenization of the liquid phase and the gas phase of the refrigerant fluid 700 when that fluid, having left the internal conduit 13, circulates along the external conduit 12 before reaching the spraying orifices 120, as described later.

The portion 16 of reduced thickness of the internal conduit 13 is for example formed by machining the tube forming the internal conduit. According to the example illustrated, the portion 16 of reduced thickness takes the form of a flat 17. By flat is meant a plane surface formed on a circular section. It is to be noted that the flat 17 extends in the example shown over at least 50% of a length of the internal conduit 13. The flat 17 preferably extends in a rectilinear manner and parallel to the principal lengthwise axis 13A of the internal conduit 13. Moreover, the communication orifice 130 is formed in such a manner as to pass through the flat 17. In other words, the flat 17 extends over at least a part of the internal conduit 13 in which the communication orifice 130 is formed.

FIG. 4 also shows that the internal conduit 13 comprises at least one single, so-called communication orifice 130, the axis 130A of which intersects the principal lengthwise axis 13A of the internal conduit 13. In the example shown in FIG. 4, the internal conduit is provided with a single communication orifice. To be more precise, the axis 130A of the communication orifice 130 is perpendicular to the principal lengthwise axis 13A of the internal conduit 13. The fluid caused to penetrate into the internal conduit 13 via the inlet opening 11 circulates along the conduit and passes through this communication orifice 130 to penetrate into the external conduit 12.

The presence of a single communication orifice 130 on the internal conduit 13, that is to say a single orifice enabling the passage from the internal conduit to the external conduit, enables the refrigerant fluid 700 to access a precise point on the external conduit 12, which enables total control of the distribution of this refrigerant fluid along the external conduit, notably preventing the fluid circulating from one longitudinal end to the other. The single communication orifice moreover enables modification of its dimension, and notably making it large enough to minimize head losses. It is clear that these two points make it possible to facilitate the development of the distribution device 10 in its application to a heat exchanger 500 regardless of the dimension of the heat exchanger 500 on which the distribution device 10 is mounted.

Whatever the dimension of the heat exchanger 500 and therefore of the internal conduit 13, the communication orifice 130 is positioned in such a manner as to open onto the central part C of the external conduit 12, that is to say a part situated at equal distances from the first spraying orifice 120*i* and the last spraying orifice 120*n*+i. As stated above, the spraying zone Z comprises a central part C extending from the middle M to plus or minus 5% of the length LZ of this spraying zone, the middle M being situated at equal distances from the first spraying orifice 120*i* and the last spraying orifice 120*n*+i. Accordingly, the refrigerant fluid 700 circulating in the internal conduit 13 is sure to discharge substantially at the middle of the spraying zone Z, which enables homogeneous feeding of the spraying orifices 120 of the external conduit 12, the term substantially signifying that the communication orifice 130 discharges at the middle M, or at least in the central part C bracketing that middle M in the proportions previously referred to.

According to a variant embodiment shown in FIG. 5, the internal conduit 13 comprises a plurality of communication orifices 130. According to this embodiment, all the communication orifices 130 are disposed in the portion 16 of reduced thickness. The plurality of communication orifices 130 enables more uniform distribution of the refrigerant fluid 700 along the spraying zone Z. To this end, the communication orifices 130 can have different diameters from one another, notably as a function of their position on the internal conduit 13.

According to these embodiments, the communication orifices 130 have a contour of circular or oblong shape. Of course, other orifice shapes are possible, such as a communication orifice having a contour of polygonal, for example decagonal shape. In all cases of these shapes, it is to be noted that the communication orifice 130 has a greater dimension, such as diameter or a diagonal, measured in a section plane perpendicular to its axis 130A, that is less than or equal to a section of the internal conduit 13. By section of the internal conduit 13 is meant the greatest internal dimension of the internal conduit 13 measured in a section plane perpendicular to the principal lengthwise axis 13A of the internal conduit 13, such as a diameter or a diagonal.

In the example shown, the internal conduit 13 has an outer diameter of 6 millimetres and an inside diameter of 4 millimetres, and the communication orifice 130 has a diameter, or a greatest dimension, equal to 4 millimetres. The fact the communication orifice 130 has a diameter substantially equal to the diameter of the internal conduit 13 enables control of the head losses on passage of the fluid between the inlet opening, consisting in a single orifice of given diameter arranged at one end of the device, and the external conduit, along which the refrigerant fluid 700 comes to be distributed to pass in a homogeneous fashion through each of the spraying orifices 120. In the case of a single communication orifice, its central position enables homogeneous feeding in that the refrigerant fluid 700 penetrating into the external conduit 12 is equally distributed to one or the other of the longitudinal ends of the distribution device.

It should be noted from the foregoing description that in the case of a single communication orifice, the optimum position of that communication orifice 130 is theoretical and such that it is located strictly in vertical alignment with the middle M of the spraying zone Z. However, it may be wished to offset the longitudinal position of this communication orifice, advantageously in corresponding relationship with the central portion C around this middle M, if a pressure imbalance is noted between the inlet and the outlet for the refrigerant fluid in the heat exchanger.

For example, if the refrigerant fluid circuit 100 of the air conditioning installation is configured so that the pressure of the refrigerant fluid at the inlet is higher than the pressure at the outlet, it is then appropriate to move the communication orifice toward the end corresponding to the inlet opening/opposite the inlet opening?

Question for Valeo: Please check which proposition is correct, and if possible explain the technical reason in a few words.

Moreover, FIG. 6 shows that the flat 17 extends over a length L17 equal to the length LZ of the spraying zone Z. In other words, the flat 17 extends over a distance L17 equal to the length LZ separating the first spraying orifice 120*i* and the last spraying orifice 120*n*+i of the longitudinal series of spraying orifices 120. Accordingly, the portion 16 of reduced thickness extends over a longitudinal part of the distribution device 10 that intersects at least partially the spraying zone Z in which all the spraying orifices 120 are formed. More generally, it can be said that the portion 16 of reduced thickness and the spraying orifices 120 are at least partially superposed in the distribution device 10. In the example shown, the portion 16 of reduced thickness and the spraying zone bearing these spraying orifices are arranged vertically overlapping one another.

This vertical overlapping is accompanied in the example shown by a particular arrangement of the flat 17, and of the communication orifice 130, the internal conduit 13 and the spraying orifices 120 of the external conduit 12. The internal conduit 13 is therefore disposed in the external conduit 12 in such a manner that the portion 16 of reduced thickness faces toward a portion of the external conduit 12 with no spraying orifices 120. In FIG. 6, it is therefore notable that the portion 16 of reduced thickness is not disposed facing the spraying zone Z. This kind of arrangement of the portion 16 of reduced thickness relative to the spraying orifices 120 enables a large communication volume 14 to be provided in a part of the external conduit 12 with no spraying orifices 120, and more particularly in a part of the external conduit opposite, and where appropriate diametrically opposite, that in which the spraying orifices are arranged, as can notably be seen in FIG. 7. As a result, a space is generated for the liquid phase of the refrigerant fluid 700 to accumulate. In fact, the refrigerant fluid 700 can penetrate into the distribution device in a diphase state and still be in that state on leaving the communication orifice 130, and the liquid phase contained in the diphase mixture of the refrigerant fluid 700, denser than the gas phase, tends to remain in the accumulation space delimited in part by the portion 16 of reduced thickness, notably because of the effect of gravity.

To encourage this separation of phases by gravity, each communication orifice 130 advantageously has an axis 130A parallel to the direction of terrestrial gravity and the flat 17 has a plane surface extending perpendicularly to the direction of terrestrial gravity.

In order for the volume in which the liquid phase accumulates to be as large as possible, the spraying orifices 120 have axes 120A perpendicular to the plane face formed by the removal of material. In other words, the spraying orifices 120 have axes 120A perpendicular to the plane of the flat 17.

Each communication orifice 130 advantageously opens onto a portion of the external conduit 12 with no spraying orifices 120. Accordingly, the communication orifices 130 are disposed facing a solid part of the external conduit 12. By solid part is meant a part of the external conduit 12 with no spraying orifices 120. Accordingly, the communication orifices 130 are not disposed facing the spraying zone Z.

The communication orifices 130 are preferably arranged in such a manner that the refrigerant fluid 700 passing through them circulates in the opposite direction to the direction of circulation of the refrigerant fluid 700 passing through the spraying orifices 120. In other words, each communication orifice 130 has an axis 130A parallel to the axes 120A of the spraying orifices 120, whilst opening in the opposite direction. When the conduits 12, 13 are coaxial and circular, it can be said that each communication orifice 130 is situated facing a part of the external conduit 12 that is diametrically opposite the spraying orifices 120. When the conduits have a shape other than circular, it can be said that each communication orifice 130 is situated facing a part of the external conduit 12 that is symmetrically opposite the spraying orifices 120. A position of this kind of the communication orifice 130 relative to the spraying orifices 120 enables the gas phase to be forced to drive the liquid phase in the direction of the spraying orifices 120.

FIG. 8 is a view in cross section of the distribution device 10 in the spraying zone Z. The two conduits 12, 13 being coaxial, it can be seen that the presence of the portion 16 of reduced thickness obtained by the removal of material situated on the external face of the internal conduit 13, that is to say the face facing toward the external conduit 12, generates a distance difference between different parts of the internal conduit 13 and the external conduit 12.

To be more precise, with the presence of the flat 17 on the internal conduit 13, there are distinguished a smallest radial distance W1 and a largest radial distance W2, it being understood that the radial distances are measured in a given section, perpendicular to the principal lengthwise axis 13A of the internal conduit 13, on a straight line segment passing through the common centre of the internal conduit and the external conduit. The smallest radial distance W1 correspond to the distance between the external face of the internal conduit 13 in a portion different from the flat 17 and the internal face of the external conduit 12. Conversely, the greatest radial distance W2 corresponds to the distance between the centre of the flat 17 and the internal face of the external conduit 12.

Depending on the dimensions of the distribution device 10, the shortest distance W1 can reach a maximum value of 0.25 millimetre to 2 millimetres, while the greatest distance W2 can reach a maximum value of 1 to 5 millimetres. Of course, the greatest distance W2 is always greater than the smallest distance W1. Accordingly, it is clear that from one distribution device 10 to another, the communication volume 14 can be larger or smaller as a function of these distances W1, W2.

FIG. 9 shows the application of the distribution device 10 comprising an internal conduit 13 with a flat 17 in a header 7 of an evaporator 600. The distribution device is placed coaxially with the header 7, in such a manner that the principal lengthwise axis of the internal conduit 13 coincides with the axis of the header 7.

Note that the external conduit 12 is arranged in the header 7 in such a manner that the spraying orifices 120 discharge opposite the zone of the external conduit into which open the tubes of the bundle of tubes 6. In an arrangement as shown in FIG. 9, in which the bundles of tubes are arranged vertically under the header 7, the external conduit 12 is adapted so that the spraying orifices open onto the top of this external conduit 12.

The spraying orifices 120 are preferably arranged so that the refrigerant fluid 700 circulates in an opposite direction relative to the direction of circulation of the refrigerant fluid 700 flowing along the bundle of tubes 6. In other words, each spraying orifice 120 has an axis 120A parallel to the axes 6A of the tubes, whilst discharging opposite those tubes, the header participating in guiding the fluid in the tube on leaving the spraying orifice. When the external conduit 12 is circular, it can be said that the spraying orifices 120 are situated facing a part of the header 7 that is diametrically opposite the bundle of tubes 6. This kind of position of the spraying orifices 120 relative to the bundle of tubes 6 enables improvement of the evaporation of the refrigerant fluid 700 before it flows along the tubes.

It is to be noted that the spraying orifices 120 are all distributed along the bundle of tubes 6. In other words, the spraying zone Z has a length LZ equal to the length of the bundle of tubes 6, the length of the bundle of tubes 6 being measured along the longitudinal axis L, parallel to the principal lengthwise axis 12A of the external conduit 12. Accordingly, it can equally be stated that the flat 17 has a length L17 equal to the length of the bundle of tubes 6. It can also be said that when the internal conduit 13 comprises a single communication orifice 130, the latter is aligned with the middle of the bundle of tubes 6.

Whatever the variant embodiment retained, the invention enables provision of a device for distribution of the refrigerant fluid offering low head losses for a homogeneous distribution of the refrigerant fluid in a header of a heat exchanger. Providing a single communication orifice in the distribution device enables an efficient heat exchanger to be obtained in which the fluid distribution device addresses these two criteria.

The invention should nevertheless not be deemed to be limited to the means and configurations described and shown, and applies equally to any means, or any configurations, that are equivalent and to all combinations of such means and/or configurations. In fact, although the invention has been described and shown in different variant embodiments each separately employing a particular arrangement, it goes without saying that these arrangements described can be combined without this compromising the invention.

The invention claimed is:

1. A device for distribution of a refrigerant fluid in a header of a heat exchanger comprising:

at least two conduits, including an external conduit and an internal conduit, with the internal conduit accommodated in the external conduit so as to form a volume for communication extending in the external conduit and between the internal conduit and the external conduit, the external conduit comprising spraying orifices each having an axis intersecting a principal lengthwise axis of the external conduit, and the internal conduit comprising one or more communication orifice having an axis intersecting a principal lengthwise axis of the internal conduit, wherein the internal conduit comprises a machined portion extending from the external face of the internal conduit, the external face facing toward the external conduit, wherein the machined portion has a reduced thickness.

2. The distribution device according to claim 1, wherein the spraying orifices are all situated in a spraying zone in which they are arranged in a longitudinal series comprising a first spraying orifice and a last spraying orifice, the first spraying orifice and the last spraying orifice being disposed at opposite ends of the longitudinal series.

3. The distribution device according to claim 1, wherein the machined portion comprises a planar surface.

4. The distribution device according to claim 1, wherein the machined portion extends over a length equal to a length of the spraying zone.

5. The distribution device according to claim 1, wherein the one or more communication orifice is disposed on the machined portion.

6. The distribution device according to claim 3, wherein the planar surface does not face the spraying orifices.

7. The distribution device according to claim 6, wherein the planar surface faces directly away from the spraying orifices.

8. The device according to claim 1, wherein the one or more communication orifice is positioned to discharge in the opposite direction of the spraying orifices.

9. The device according to claim 1, wherein the one or more communication orifice has a diameter substantially equal to the inner diameter of the internal conduit.

10. The device according to claim 2, wherein the internal conduit comprises one communication orifice, wherein the one communication orifice is positioned substantially equidistant to the first spraying orifice and the last spraying orifice.

11. The device according to claim 3, wherein the planar surface extends at least half the length of the internal conduit.

12. The device according to claim 3, wherein the planar surface extends to the one or more communication orifice.

13. The header according to claim 7, wherein the machined portion comprises a planar surface.

14. The header according to claim 13, wherein the planar surface faces directly away from the spraying orifices.

15. The header according to claim 13, wherein the one or more communication orifice is positioned on the planar surface.

16. A refrigerant fluid header for a heat exchanger comprising:

a distribution chamber, wherein the distribution chamber accommodates a distribution device comprising:

at least two conduits, including an external conduit and an internal conduit, with the internal conduit accommodated in the external conduit so as to form a volume for communication extending in the external conduit and between the internal conduit and the external conduit, the external conduit comprising spraying orifices each having an axis intersecting a principal lengthwise axis of the external conduit, the internal conduit comprising one or more communication orifice having an axis intersecting a principal lengthwise axis of the internal conduit, wherein the internal conduit comprises a machined portion extending from the external face of the internal conduit, the external face facing toward the external conduit, wherein the machined portion has a reduced thickness, and wherein the internal conduit of the distribution device comprises an inlet opening for admission of the refrigerant fluid and the spraying orifices are arranged in such a manner as to allow circulation of the refrigerant fluid between the distribution device and the distribution chamber.

17. A heat exchanger comprising:

a refrigerant fluid header comprising:

a distribution chamber, wherein the distribution chamber accommodates a distribution device comprising:

at least two conduits, including an external conduit and an internal conduit, with the internal conduit accommodated in the external conduit so as to form a volume for communication extending in the external conduit and between the internal conduit and the external conduit, the external conduit comprising spraying orifices each having an axis intersecting a principal lengthwise axis of the external conduit, the internal conduit comprising one or more communication orifice having an axis intersecting a principal lengthwise axis of the internal conduit, wherein the internal conduit comprises a machined portion extending from the external face of the internal conduit, the external face facing toward the external conduit, wherein the machined portion has a reduced thickness, and tubes forming a bundle of tubes extending from the header characterized in that the internal conduit of the distribution device is oriented in such a manner that the machined portion is perpendicular to the bundle of tubes.

18. The heat exchanger according to claim 17, wherein the machined portion of is formed over a length of the internal conduit equal to a length of the bundle of tubes.

19. The heat exchanger of claim 17, wherein the machined portion comprises a planar surface.

20. The heat exchanger of claim 19, wherein the one or more communication orifice is positioned on the planar surface.

* * * * *